US005603589A

United States Patent [19]

von Allmen et al.

[11] Patent Number: 5,603,589

[45] Date of Patent: Feb. 18, 1997

[54] METHOD FOR MANUFACTURING AN ANCHOR ELEMENT FOR A SOIL ANCHOR FOR A ROCK ANCHOR, ROCK BOLT OR THE LIKE, FROM A STRAND OF TWISTED STEEL WIRE

[75] Inventors: Hans-Peter von Allmen, Bäretswil, Switzerland; Reinhard Klöckner; Engelbert Gött, both of Munich, Germany; Otmar Langwadt, Markt Schwaben, Germany

[73] Assignee: Dyckerhoff & Widmann Aktiengesellschaft, Munich, Germany

[21] Appl. No.: 525,460

[22] Filed: Sep. 8, 1995

[30] Foreign Application Priority Data

Sep. 9, 1994 [DE] Germany ..... 44 32 128.7

[51] Int. Cl.[6] ..... E21D 20/02

[52] U.S. Cl. ..... 405/302.2; 57/204; 405/259.5

[58] Field of Search ..... 405/259.1–259.6, 405/302.2, 244; 52/155, 223.1; 57/204; 211/82

[56] References Cited

U.S. PATENT DOCUMENTS

| | | | |
|---|---|---|---|
| 3,494,134 | 2/1970 | Jorge | 405/259.5 |
| 3,899,892 | 8/1975 | Yokota et al. | 405/259.5 |
| 4,333,306 | 6/1982 | Yamashita et al. | 57/206 |
| 4,790,129 | 12/1988 | Hutchins | 57/204 |
| 5,288,176 | 2/1994 | Huff et al. | 405/302.2 X |
| 5,472,296 | 12/1995 | Von Allmen et al. | 405/244 X |

FOREIGN PATENT DOCUMENTS

| | | | |
|---|---|---|---|
| 4203740 | 8/1993 | Germany . | |
| 1530784 | 12/1989 | U.S.S.R. | 405/302.2 |

*Primary Examiner*—Dennis L. Taylor
*Attorney, Agent, or Firm*—Friedrich Kueffner

[57] ABSTRACT

A method of manufacturing an anchor element for a soil anchor or rock anchor, rock bolt or the like, from a strand of twisted steel wire. The anchor element includes a central wire and outer wires arranged radially relative to the central wire. The anchor element has at least one expanded section obtained by spreading the individual wires. Spacer members are provided for fixing the individual wires in the spread-apart position. The central wire is laterally deflected when the individual wires of the strand are being spread and, by inserting a rod-shaped spacer element, the central wire is fixed in an out of center position together with at least one outer wire.

18 Claims, 4 Drawing Sheets

Fig. 7a
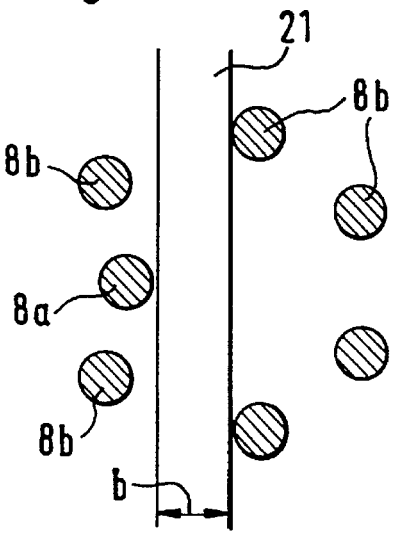
Fig. 7b
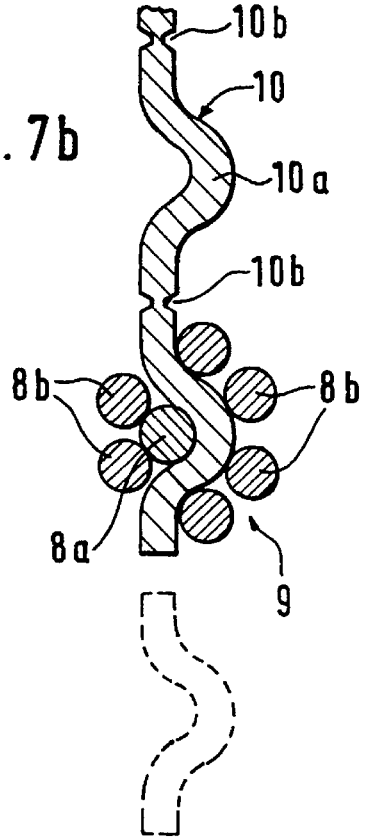
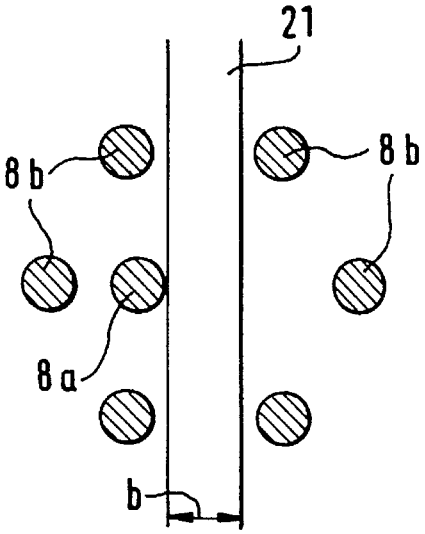
Fig. 8a
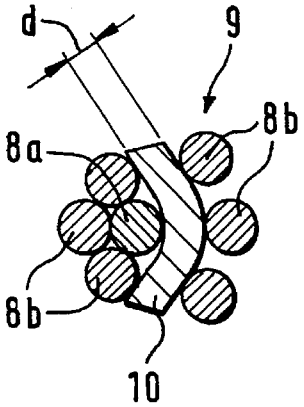
Fig. 8b

METHOD FOR MANUFACTURING AN ANCHOR ELEMENT FOR A SOIL ANCHOR FOR A ROCK ANCHOR, ROCK BOLT OR THE LIKE, FROM A STRAND OF TWISTED STEEL WIRE

BACKGROUND OF THE INVENTION

1. Field of the Invention

The present invention relates to a method of manufacturing an anchor element for a soil anchor or rock anchor, rock bolt or the like, from a strand of twisted steel wire. The anchor element includes a central wire and outer wires arranged radially relative to the central wire. The anchor element has at least one expanded section obtained by spreading the individual wires. Spacer members are provided for fixing the individual wires in the spread-apart position.

2. Description of the Related Art

For securing excavated cavities in mining, particularly coal mining, it is known to use rock bolts which are usually placed immediately after driving the cavity. Such rock bolts are usually composed of an anchor element of steel, for example, a steel rod, a steel pipe or the like, which is placed in a bore hole and a bonding action between the anchor element and the rock is achieved by filling the bore hole with a hardening material, for example, cement mortar or synthetic resin.

Longer rock bolts of the above-described type cannot be used, or can only be used under great difficulties for longer bore holes, sometimes up to 15 m, because of the limited space available on location within narrow cavities. Accordingly, anchor elements of steel wire strands are frequently also used as rock bolts. Steel wire strands are made from twisted high-strength steel wire; they are flexible within certain limits and can be bent for inserting them within a bore hole. However, steel wire strands have a very smooth surface because of strain hardening during drawing, so that the forces resulting from the bonding action between the strands the hardening material filling out the bore hole are frequently not sufficient for preventing the separation of layers in the rock formation.

In order to improve the bonding action of steel wire strands when used as rock anchors, it is known to produce expanded sections by spreading the individual wires into which the material can penetrate, in order to improve the bonding action. The expanded sections are arranged spaced apart from each other over the length of the rock anchor. The expanded sections are produced in a method of the above-described type by guiding the strand in an axial feeding direction through a rotatably mounted spreading disk which is provided with openings and by mounting spacer elements for fixing the individual wires in the spread-apart position in the areas where the individual wires have been spread apart by the spreading disk, as disclosed by DE 42 03 740 A1. The spacer elements are constructed and arranged in such a way that the radial symmetry of the strands is not impaired in the areas of the expanded sections, i.e., the central wire extends through a central opening of a circular or polygonal spacer element, while the outer wires rest against the outer circumference of the spacer elements.

As a rule, steel wire strands as they are used in this connection are composed of seven steel wires, wherein six outer wires are grouped around a central wire. When the outer wires are bent outwardly as a result of the spreading action for mounting the spacer elements, differences in length occur in the final state between the outer wires and the central wire. In the case of short strands, or when expanded sections are provided only over the short anchoring length of the strand, these length differences can be compensated by longitudinal displacement of the central wire. However, this phenonemon prevents a continuous manufacture of longer strands in a simple continuous process because the central wire will laterally buckle toward the outer wires after a limited number of expansions because of the fact that the length differences add up. It would be possible to sever the central wire at axially spaced-apart locations, or to cut out individual pieces of the central wire at certain locations; however, this would require additional work steps which prevent an economical manufacture.

SUMMARY OF THE INVENTION

Therefore, it is the primary object of the present invention to make it possible to at least minimize the length differences between the central wire and the outer wires which occur when the expanded sections are produced. Moreover, it should be possible to manufacture such strands in a continuous process.

In accordance with the present invention, the central wire is laterally deflected when the individual wires of the strand are being spread and, by inserting a rod-shaped spacer element, the central wire is fixed in an out of center position together with at least one outer wire.

By using a rod-shaped spacer element which is inserted transversely of the longitudinal axis of the strand, the radially symmetrical arrangement of the strand wires is destroyed and a unilateral deflection of the central wire together with one outer wire or several outer wires is obtained. By an appropriate selection of the diameter of the rod-shaped spacer element and the number of outer wires deflected together with the central wire, it is possible to dimension the deflection of the central wire in dependence on the diameter of the expanded sections in such a way that the length differences occurring between the central wire and the outer wires because of the expanded sections can be minimized even over great lengths. This is possible when the strand wires are spread apart manually at certain locations by means of an appropriate tool, as well as when spreading is carried out in a continuous process with the use of a spreading disk which is known in the art and whose arrangement of openings is selected appropriately.

Another advantage of the use of rod-shaped spacer elements inserted in transverse direction is the smaller diameter of the expanded sections which can be achieved as a result, as compared to when radially symmetrical spaces are used. This is because it has been found that the highest strengths, i.e., reaching of the breaking load, can be achieved with relatively small expanded sections. This suggests that intended breaking points which are sheared off in the case of a tensile load are produced at the expanded sections between the enclosed mortar cone and the external mortar between the individual strand wires. It is then possible that the enclosed cone is wedged as a result of a wedge effect against the outer cement mortar, so that the individual strand wires are subjected to a clamping action. As tests have shown, this takes place especially when the diameter of the expanded sections corresponds to approximately 1.3 to 2 times the diameter of the strand in the unspread state.

On the other hand, in smooth strands which have no expanded sections, there is the danger that the smooth strand wires can be screwed out of the concrete. Similar phenomena are also observed in the case of large expanded sections; in that case, the enclosed cone is in connection with the outer cement mortar over relatively large areas between the strand wires. There is the danger that the individual strand wires can be individually pulled out of the structural concrete component.

The relatively small diameter of the expanded sections compared to the diameter of the unspread strand together with the fact that the spacer elements do not project beyond the envelope of the strand wires produce the result that the expanded sections act as integrated spacers of the strands and, in the case of bundle-type anchors composed of several strands, ensure that the injected material completely penetrates the strand bundle. When the spacer elements project laterally beyond the envelope of the strands, the laterally projecting portions form spacer members, for example, between the strand and the bore hole; simultaneously, they can secure the anchor element against falling out during the hardening time of the injected material in the bore hole. In the case of glued anchors of synthetic resin, the projecting portions of the spacer elements can serve to intensify and, thus, shorten the mixing procedure during the mechanical rotation of the anchor elements.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 6*a* through 8*b* are schematic illustrations of different combinations of openings of the spreading disk and the expanded sections produced by the spreading disk;

DESCRIPTION OF THE PREFERRED EMBODIMENTS

Figure 1:
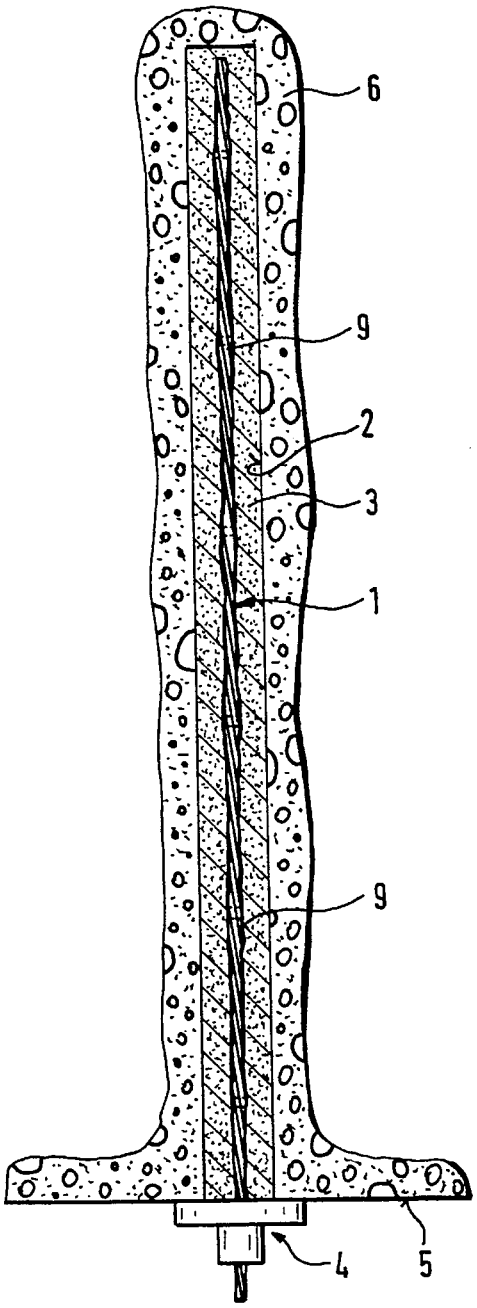
FIG. 1 is a schematic longitudinal sectional view of a rock bolt.

FIG. 1 of the drawing is a schematic longitudinal sectional view of a rock anchor, wherein an anchor element 1 is inserted in a bore hole 2 by filling out the remaining annular space with a hardening material 3, for example, synthetic resin, cement mortar or the like. Toward the open side, the anchor element 1 is anchored by an anchoring system 4, for example, a conventional wedge-type anchoring system, in order to secure the outer surface 5 of the rocket 6.

Figure 2:
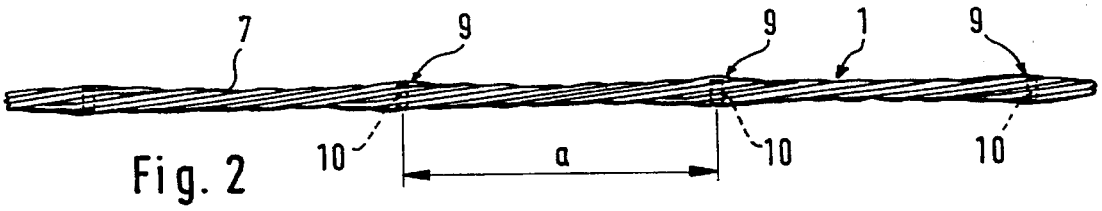
FIG. 2 shows a portion of an anchor element manufactured from a strand in accordance with the present invention.
Figure 3:
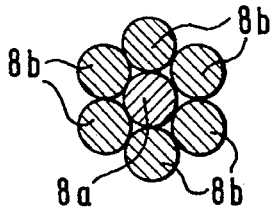
FIG. 3 is a cross-sectional view, on a larger scale, of the strand in the unspread state.

FIG. 2 shows an anchor element 1 which is suitable for such a rock bolt, wherein the anchor element 1 is to be manufactured in accordance with the method of the invention. The anchor element 1 is composed of a steel wire strand 7 which, in the simplest case, is composed of seven steel wires 8, wherein six outer wires 8*b* are grouped around a central wire 8*a*, as shown in FIG. 3. The strand 7 is provided with expanded sections 9 in which spacer elements 10 are arranged in order to hold the steel wires 8 in the spread-apart position. The expanded sections 9 are preferably arranged at equal distances a from each other.

Figure 6A:
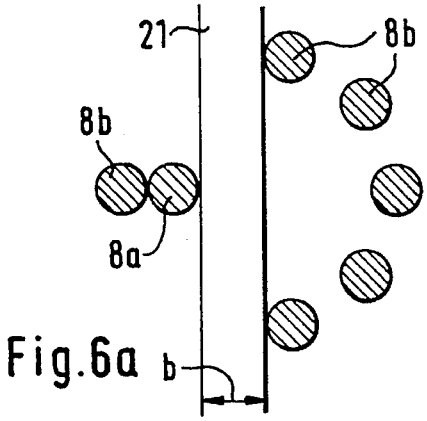
Figure 6B:
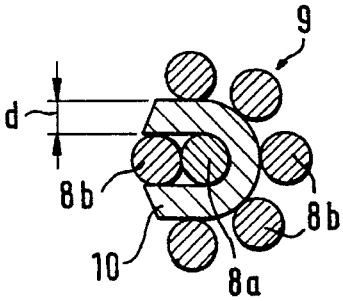

In order to insert rod-shaped spacer elements 10 as they are illustrated particularly in FIGS. 6*b*, 7*b* and 8*b*, it is possible in the simplest case to spread the strand wires 8 at the appropriate locations by means of a simple tool to be inserted in a direction extending transversely of the longitudinal direction of the strand 2 and to produce a path in this manner, wherein a rod-shaped spacer element 10 can be inserted into this path. A tool suitable for this purpose is, for example, a pair of tongs which have jaws shaped in accordance with the lay of the outer wires of the strand, wherein the jaws forcibly deflect the central wire 8*a* toward one side.

Figure 4:
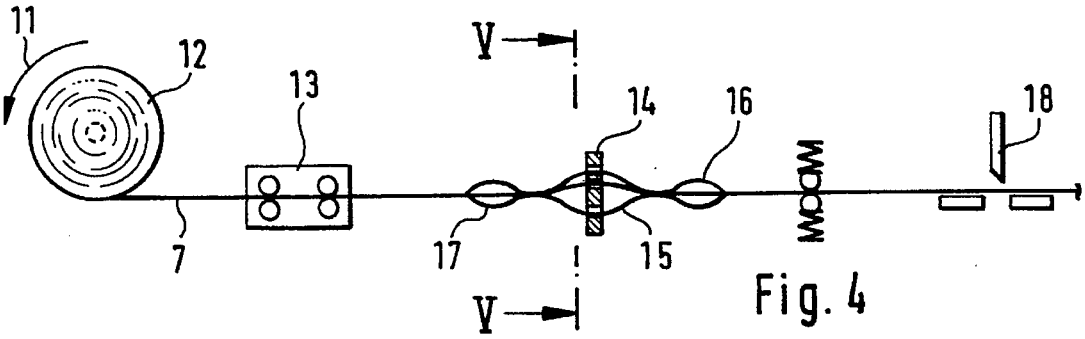
FIG. 4 is a schematic illustration of an apparatus including a spreading disk for carrying out the method according to the present invention.

Particularly in the case of longer strands, it is more economical to manufacture the expanded sections in a continuous process which can be explained with the aid of the arrangement schematically illustrated in FIG. 4. In that process, the strand 7 is pulled from a wire roll 12 in a direction indicated by arrow 11 and is advanced in axial direction by means of an advancing device 11. The strand 7 is then passed through a rotatably mounted spreading disk 14 in which the individual wires 8 of the strand 7 are spread apart. As the strand 7 is passed through in the area of the spreading disk 14, stationary waves are formed in the strand. The waves include a main wave 15 in the region of the maximum expansion and a smaller wave 16 in front of the main wave 15 and another small wave 17 following the main wave 15, before the individual wires 8 are again combined and are transported to a cutting device 18 in which the individual anchor elements 1 are cut to length. The spacer elements 10 are preferably inserted in the area of the maximum expansion, i.e., in the area of the main wave 15 immediately following the spreading disk 14.

Figure 5:
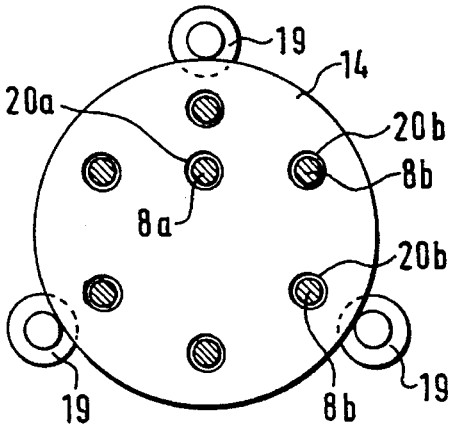
FIG. 5 is a sectional view of the spreading disk taken along sectional line V—V in FIG. 4.

An important aspect of the insertion of the rod-shaped spacer elements 10 is the guidance of the individual wires of the strand 7 in such a way that a lateral deflection of the central wire 8*a* is achieved. A spreading disk suitable for carrying out the method according to the present invention is shown in FIG. 5 in a front view. The rotatable mounting of the spreading disk 14 can be effected, for example, by means of rollers 19 between which the spreading disk 14 is supported and on which the circumference of the spreading disk 14 rolls off. The spreading disk 14 proper has a number of openings 20 through which the strand wires 8 are passed. In the illustrated embodiment, the openings include an inner opening 20*a* for the central wire 3*a* and six outer openings 20*b* located on a circle for the outer wires 8*b*. The wires 8 are manually inserted into the openings 20. When the strand 7 is passed through the spreading disk 14 in the above-described manner by the force produced by the advancing device 13, the spreading disk 14 is rotated as determined by the direction of twisting of the wires of the strand 7.

FIGS. 6*a* through 8*b* show several possibilities for inserting a rod-shaped spacer element 10 into a strand having seven wires in order to produce an expanded section. In these illustrations, FIGS. 6*a*, 7*a* and 8*a* show the positions of the strand wires 8 resulting from the arrangement of the openings 20 on the spreading disk 14, wherein a path 21 extending transversely of the direction of deflection of the central wire 8*a* is formed, so that the spacer elements 10 can be inserted along the path 21 in a direction extending transversely of the feed direction of the strand 2. The width b of the path 21 must be large enough to make it possible to reliably insert the rod-shaped spacer element 10 which preferably has a circular cross-section with a diameter d. The illustrations of FIGS. 6*b*, 7*b* and 8*b* show the respective strand 2 after leaving the spreading disk 14 in the areas of the expanded sections 9 produced by the spacer elements 10.

In the illustration of FIG. 8*a*, the openings 20 in the spreading disk 14 are arranged in such a way that the outer wires 8*b* are located at equal distances from each other and only the central wire 8*a* is laterally deflected. By inserting a spacer element 10 along the path 21, the configuration showing FIG. 8*b* is obtained in which the central wire 8*a* is deflected to one side together with three outer wires 8*b*, while the remaining three outer wires 8*b* are located on the opposite side.

In the illustration of FIG. 6*a*, the arrangement of the openings 20 in the spreading disk 14 is such that the central wire 8*a* is deflected laterally together with only one outer wire 8*b*, while the remaining five outer wires 8*b* are arranged on the opposite side of the path 21 and are spaced from each other by small distances. After inserting a rod-shaped spacer element 10, the configuration shown in FIG. 6*b* is obtained in which the spacer element 10 is approximately U-shaped and the central wire 8*a* and one outer wire 8*b* are located between the sides of the U-shaped spacer element 10, while the remaining outer wires 8*b* are located on the outside of the spacer element 10.

In the simplest case, the spacer element 10 may be composed of a rod which is inserted with one end into the spread-apart strand in the direction of path 21 and is then cut to the appropriate length. The spacer element 10 may be composed of a rod of synthetic material having a circular cross-section with a diameter d, wherein the rod is deformed by the restoring forces of the individual wires 8. However, it is also possible to use preshaped elements, also of metal wire, which are provided with the appropriate shape before being inserted.

Another possibility to be considered advantageous is shown in FIGS. 7*a* and 7*b*. In this case, as shown in FIG. 7*b*, the spacer elements 10 are provided with preformed bends 10*a* and are connected through intended breaking points 10*b* to form a rod-shaped element. When a path 21 is formed by deflecting the central wire 8*a* together with two outer wires 8*b*, as shown in FIG. 7*a*, a rod formed of such spacer elements 10 can be inserted in the direction of the path 21 until the central wire 8*a* comes into contact with the bend 10*a*. By severing the spacer element 10*a* inserted in this manner along an intended breaking point 10*b*, the spacer element remains in the strand and the next spacer element can be inserted.

Figure 10:
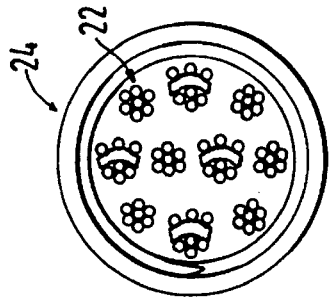
FIG. 10 is a cross-sectional view of the anchor element of FIG. 9.
Figure 9:
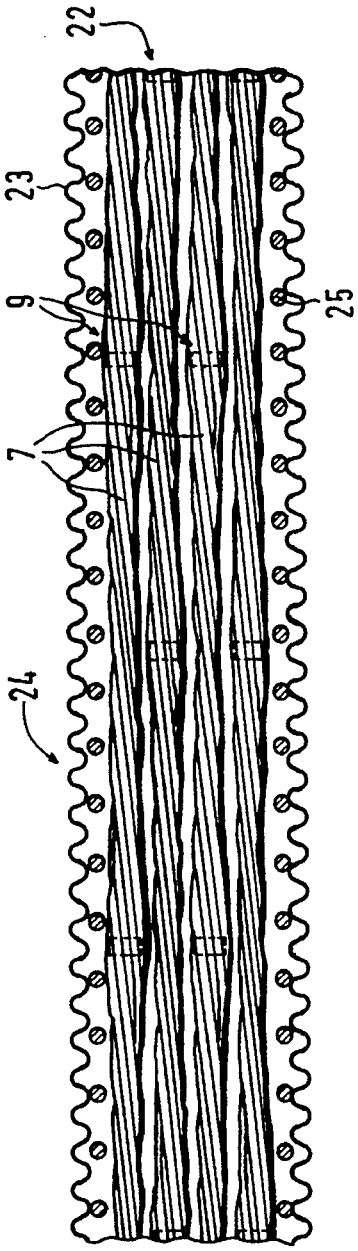
FIG. 9 is a partial longitudinal, sectional view of an anchor element for a bundle-type anchor.

The strand 7 provided with expanded sections 9 in accordance with the present invention can not only be used as a single-piece anchor element, as it is illustrated in FIG. 1; rather, several strands 7 can be combined within a tubular sheathing 23 into a bundle 22 to form a prestressing element 24. Such a prestressing element 24 in the form of a bundle is illustrated in FIG. 9 in a longitudinal sectional view and in FIG. 10 in a cross-sectional view. In this case, several strands 7 provided with expanded sections 9 are combined in such a way that the expanded sections 9 of adjacent strands are offset relative to each other; consequently, the spacing between adjacent strands 7 is fixed and, when hardening material is injected later, it is ensured that the individual strands 7 are completely and tightly surrounded by the hardening material.

It is of particular advantage in this case that the spacer elements 10 do not protrude beyond the envelope of the strand wires 8 in the areas of the expanded sections 9. As a result, spacer members are not required. Such spacer members would otherwise have to be used in order to keep the individual strands 7 at such a distance from each other that the strands 7 are completely surrounded by the hardening material. Consequently, the sheathing 23 can be initially inserted into a bore hole as a unit separately from the strand bundle 22 and can be tested for water tightness, for example, by means of an electrical resistance measurement. This makes it possible to minimize from the outset, or even entirely exclude, any possible causes of later corrosion of the anchor as a result of the penetration of aggressive media or because of the flow of stray currents.

The entire bundle 22 can be manufactured on location by inserting the individual strands 7 successively into the sheathing tube 23. Especially in the case of long and large anchors and, thus, heavy anchors, this simplifies the assembly phase and reduces the risk of damage to the tubing. The expanded sections 9 are steadily developed from the normal pattern of the strands 7, so that a displacement of the strands 7 relative to each other is easily possible. The required cover with hardening material opposite the sheathing tube 23 can be achieved, for example, by first mounting a spiral 25 of steel wire in the sheathing tube 23.

Figure 11:
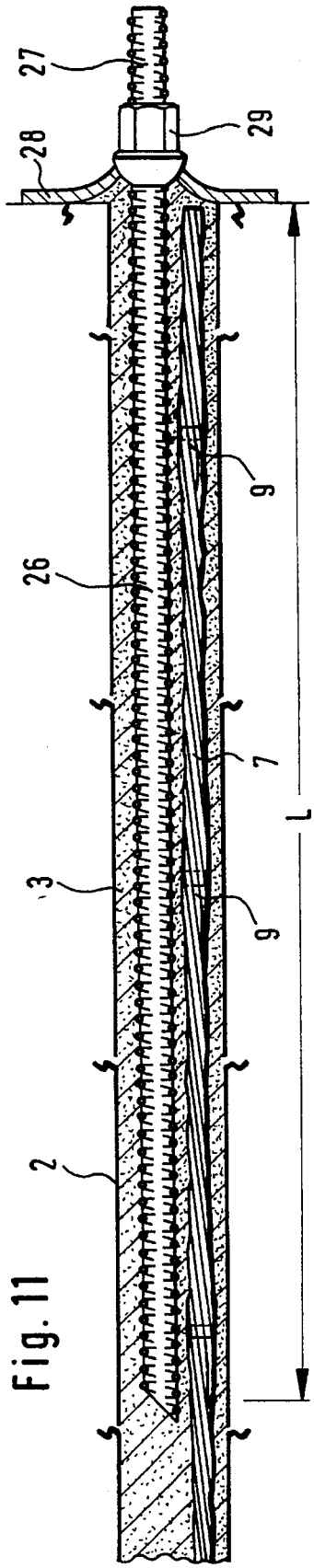
FIG. 11 is a longitudinal sectional view of a rock anchor in which an anchor element composed of a strand is jointed with a rod-shaped anchor element.

While strands 7 serving as anchor elements can be anchored at the open side of the bore hole by means of wedge-type anchoring systems, the increased bonding action of the strands produced according to the present invention because of the expanded sections 9 provides the additional possibility of joining such a strand 7, for example, in the anchoring area with a profiled steel rod 26 with screw threads, as shown in FIG. 11. The two components, i.e., strand 7 and rod 26 whose load carrying capacities are adapted to each other, overlap in the filled bore hole in the manner of an overlapping joint which is known from reinforced concrete construction, wherein only the end 27 of the rod 26 protrudes out of the bore hole, so that an anchor plate 28, a nut 29 and other installations can be fastened to the anchor in a positively locking manner and without slippage. The length L of overlap between the rod end and the strand 7 is determined by the bonding characteristics of the two components and by the transverse stiffness of the adjacent rock which may also be under arch pressure. Finally, such an overlapping joint makes it possible to adapt the anchor within a short time to preexisting bore hole lengths.

While specific embodiments of the invention have been shown and described in detail to illustrate the inventive principles, it will be understood that the invention may be embodied otherwise without departing from such principles.

We claim:

1. A method of manufacturing an anchor element for a soil anchor or rock anchor, rock bolt or the like, from a steel wire strand composed of a central wire and a plurality of outer wires arranged radially around the central wire, the steel wire strand having an axis, the method comprising forming at least one expanded section by spreading apart the wires and inserting a spacer element for fixing the wires in a spread-apart position, wherein, when spreading apart the wires, the central wire is deflected transversely from the axis of the strand, and wherein at least one outer wire is secured by the spacer element in an out of center position together with the central wire.

2. The method according to claim 1, comprising inserting a rod-shaped spacer element.

3. The method according to claim 1, comprising forming a plurality of expanded sections, wherein the expanded sections are spaced axially at equal distances from each other.

4. The method according to claim 1, comprising spreading the wires of the strand by inserting a tool between the wires in a direction transversely of the axis of the strand.

5. The method according to claim 1, comprising forming the at least one expanded section by guiding each wire in axial direction through one of a plurality of openings of a rotatably mounted spreading disk, wherein each wire is guided through one of the openings.

6. The method according to claim 1, comprising inserting the spacer element having an essentially straight shape between the spread-apart wires and allowing the spacer element to be deformed by restoring forces of the spread-apart wires.

7. The method according to claim 1, comprising inserting an essentially U-shaped spacer element between the spread-apart wires.

8. The method according to claim 1, wherein the spacer element has a diameter and the strand has a diameter in the unspread state, comprising selecting the diameter of the expanded section so as to correspond to 1.3 to 2 times the diameter of the strand in the unspread state.

9. The method according to claim 1, comprising spreading apart the wires by forming a path between the wires, wherein the path extends transversely of the transverse direction of deflection of the central wire, wherein the spacer element is inserted into the path.

10. The method according to claim 1, comprising selecting a length of the spacer element such that the spacer element does not project beyond an envelope of the spread-apart wires.

11. The method according to claim 1, comprising selecting a length of the spacer element such that the spacer element projects beyond an envelope of the spread-apart wires.

12. A method of manufacturing a soil anchor or rock anchor composed of a bundle of individual anchor elements, the method comprising manufacturing each individual anchor element from a steel wire strand composed of a central wire and a plurality of outer wires arranged radially around the central wire and forming at least one expanded section along an anchoring length of the anchor by spreading apart the wires and inserting a spacer element for fixing the wires in a spread-apart position, wherein, when spreading apart the wires, the central wire is deflected transversely from an axis of the strand, and securing at least one outer wire by the spacer element in an out-of-center position together with the central wire, and mounting the individual anchor elements in an essentially parallel position, so that the expanded sections hold the individual anchor elements spaced apart from each other.

13. The method according to claim 12, comprising inserting the individual anchor elements successively into a tube and filling out with a hardening material a remaining space between the anchor elements and the tube.

14. The method according to claim 13, wherein the hardening material is cement paste.

15. The method according to claim 13, comprising, prior to inserting the individual anchor elements into the tube, mounting a spiral of steel wire in the tube so as to extend at least over the anchoring length and so as to rest against an inner wall of the tube.

16. A rock bolt comprising an anchor element composed of a steel wire strand having a central wire and a plurality of outer wires arranged radially around the central wire, the steel wire strand having an axis and a plurality of expanded sections obtained by spreading apart the wires of the strand and inserting a spacer element for fixing the wires in a spread-apart position, wherein the central wire is deflected transversely from the axis of the strand and wherein at least one outer wire is secured by the spacer element in an out of center position together with the central wire, the expanded sections being spaced apart from each other at equal spacings, the anchor element being placed in a bore hole having an opening, the bore hole being filled with a hardening material, further comprising a profiled steel rod connected in the area of the opening of the bore hole to the anchor element, the steel rod having an end protruding out of the bore hole, the steel rod having on its end protruding out of the bore hole a thread for screwing on an anchoring member.

17. The rock bolt according to claim 16, wherein the hardening material is cement paste.

18. The rock bolt according to claim 16, wherein the anchor element and the steel rod overlap each other in the bore hole filled with hardening material over a length required for transmitting an anchoring force.

* * * * *